US012479612B2

(12) United States Patent
Morri et al.

(10) Patent No.: US 12,479,612 B2
(45) Date of Patent: Nov. 25, 2025

(54) SELF-PROPELLED WRAPPING MACHINE

(71) Applicant: ROBOPAC S.P.A., Acquaviva-Gualdicciolo (SM)

(72) Inventors: Marco Morri, Acquaviva-Gualdicciolo (SM); Valerio Savioli, Acquaviva-Gualdicciolo (SM)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 0 days.

(21) Appl. No.: 18/290,996

(22) PCT Filed: Jul. 20, 2022

(86) PCT No.: PCT/IB2022/056710
§ 371 (c)(1),
(2) Date: Jan. 22, 2024

(87) PCT Pub. No.: WO2023/002408
PCT Pub. Date: Jan. 26, 2023

(65) Prior Publication Data

US 2025/0100728 A1 Mar. 27, 2025

(30) Foreign Application Priority Data

Jul. 23, 2021 (IT) ..... 102021000019655

(51) Int. Cl.
*B65B 11/02* (2006.01)
*B65B 11/00* (2006.01)
(Continued)

(52) U.S. Cl.
CPC ..... *B65B 11/025* (2013.01); *B65B 11/006* (2013.01); *B65B 41/16* (2013.01); *B65B 57/04* (2013.01); *B65B 2011/002* (2013.01)

(58) Field of Classification Search
CPC ..... B65B 11/025; B65B 11/006; B65B 41/16; B65B 57/04; B65B 2011/002
See application file for complete search history.

(56) References Cited

U.S. PATENT DOCUMENTS 4,095,395 A * 6/1978 Goldstein ..... B65B 11/025 53/210
6,170,228 B1 * 1/2001 Zeman, III ..... B65B 11/025 53/74

(Continued)

FOREIGN PATENT DOCUMENTS

CN 202481348 U * 10/2012
CN 111038759 A * 4/2020 ..... B65B 11/025

(Continued)

OTHER PUBLICATIONS

International Search Report (ISR) issued Oct. 4, 2022 in International (PCT) Application No. PCT/IB2022/056710.

*Primary Examiner* — Anna K Kinsaul
*Assistant Examiner* — Mobeen Ahmed
(74) *Attorney, Agent, or Firm* — Wenderoth, Lind & Ponack, L.L.P.

(57) ABSTRACT

A self-propelled wrapping machine has a self-propelled carriage, an upright fixed to the carriage, slidably supporting a moving slide, and provided with a connection assembly, a first actuator arrangement to move the carriage around a load and the moving slide along the upright, and an unwinding unit provided with a reel of film and a roller assembly and including a quick coupling assembly selectively couplable to the connection assembly. The machine also has a main drive and control system configured to operate the first actuator arrangement and a complementary drive and control system configured to operate second and/or third actuator arrangements acting on the roller assembly and/or to receive and process signals relating to operating parameters of the (Continued)

unwinding unit from a sensor device thereof. The main and complementary drive and control systems are reversibly electrically connectable to each other to exchange control signals and transfer electric power supply.

14 Claims, 7 Drawing Sheets

(51) Int. Cl.
*B65B 41/16* (2006.01)
*B65B 57/04* (2006.01)

(56) References Cited

U.S. PATENT DOCUMENTS 7,946,096 B2 * 5/2011 Murarotto ..... B65B 11/025 53/582
8,001,745 B2 * 8/2011 Carter ..... B65B 57/02 53/64
8,453,420 B2 * 6/2013 Schmidt ..... B65B 11/045 53/556
10,183,773 B2 * 1/2019 Zierden ..... B65B 11/025
10,549,870 B2 * 2/2020 Luo ..... B65B 57/08
11,377,240 B2 * 7/2022 Spallino ..... B65B 11/025
2002/0174628 A1 * 11/2002 Lancaster, III ..... B65B 11/025 53/441
2003/0200732 A1 * 10/2003 Maki-Rahkola ..... B65B 41/16 53/589
2007/0022715 A1 * 2/2007 Wegner ..... B65B 25/14 53/167
2007/0169442 A1 * 7/2007 Asioli ..... B65B 11/025 53/588
2009/0313942 A1 * 12/2009 Murarotto ..... B65B 11/025 53/203
2010/0025517 A1 * 2/2010 Cere ..... B65B 11/025 242/559.1
2010/0300049 A1 * 12/2010 Schmidt ..... B65B 57/04 53/461
2014/0053502 A1 * 2/2014 Pecchenini ..... B65B 11/025 53/218
2014/0123605 A1 * 5/2014 Cere' ..... B65B 67/08 53/461
2014/0174027 A1 * 6/2014 Cere' ..... B65B 11/025 53/203
2015/0047301 A1 * 2/2015 Messersi' ..... B65B 11/025 53/556
2016/0122053 A1 * 5/2016 Zierden ..... B65B 41/16 53/556
2018/0194503 A1 * 7/2018 Luo ..... B65B 57/16
2019/0002138 A1 * 1/2019 Laghi ..... B65B 41/16
2021/0253284 A1 * 8/2021 Battistoni ..... B65B 67/08
2021/0276743 A1 * 9/2021 Spallino ..... B65B 11/025
2021/0309401 A1 * 10/2021 Lopes ..... B65H 23/044

FOREIGN PATENT DOCUMENTS

CN 211568376 U * 9/2020
CN 112644756 A * 4/2021
CN 218055736 U * 12/2022
EP 2 974 642 1/2016
EP 3 070 003 10/2017
WO 2020/012327 1/2020

* cited by examiner

Fig. 3
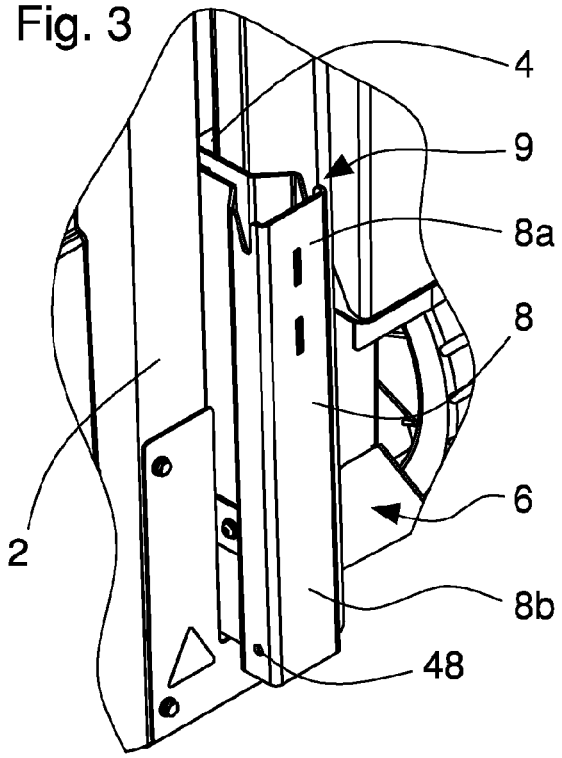
Fig. 7
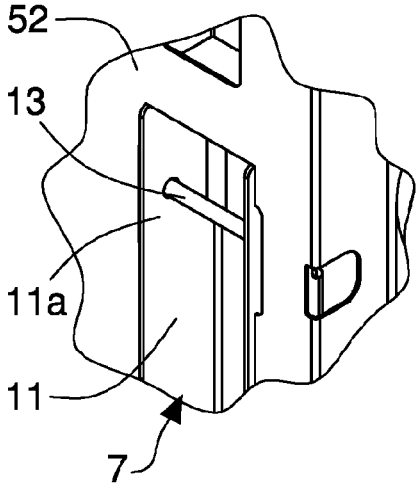
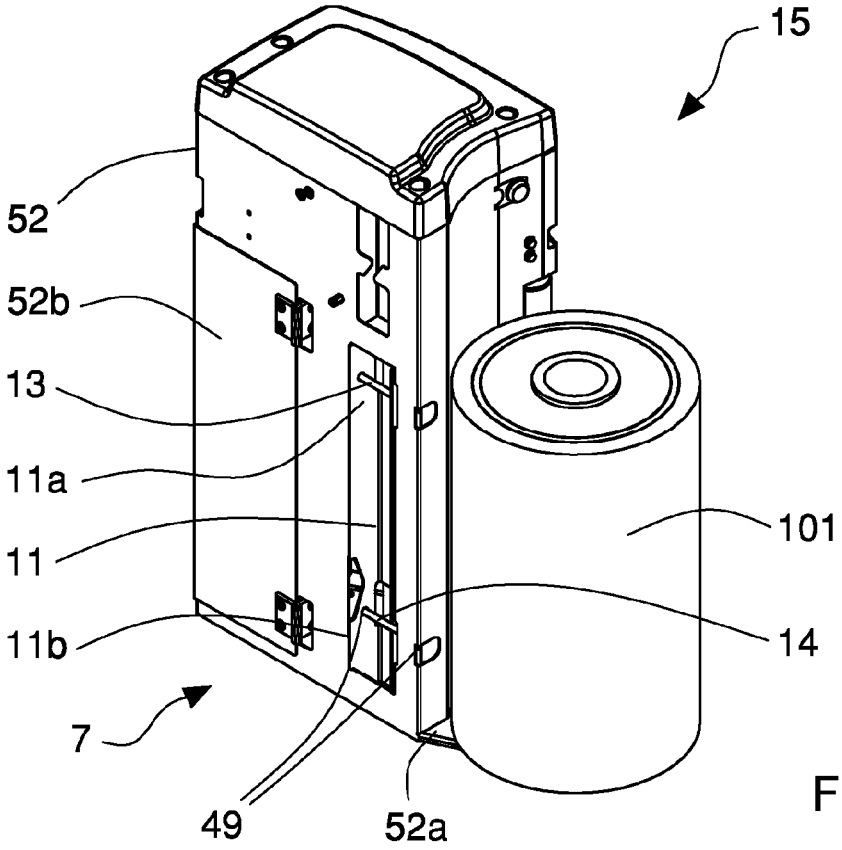
Fig. 6

Fig. 4
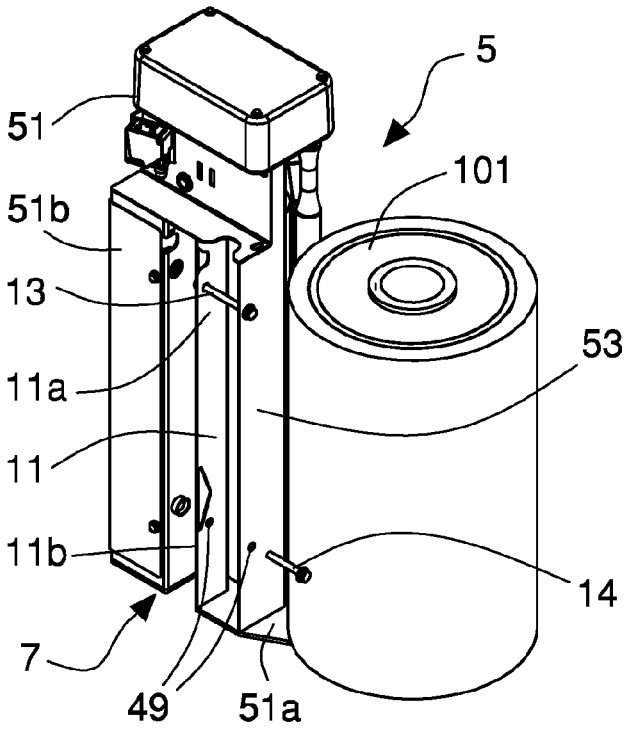
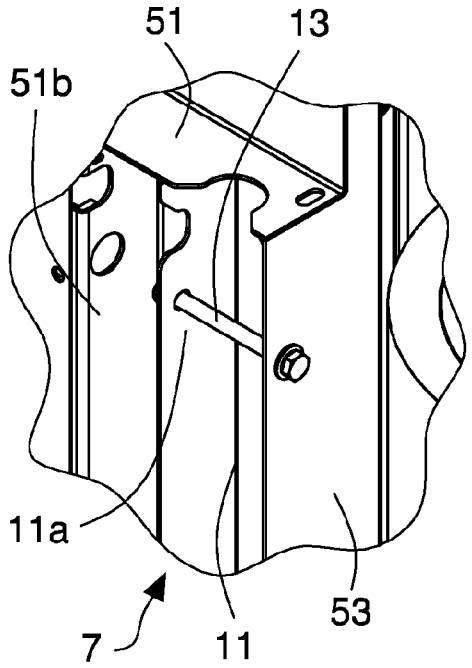
Fig. 5
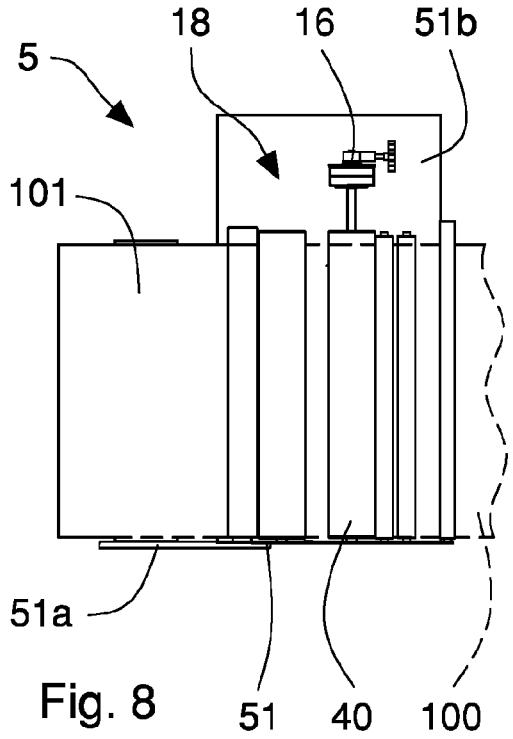
Fig. 8
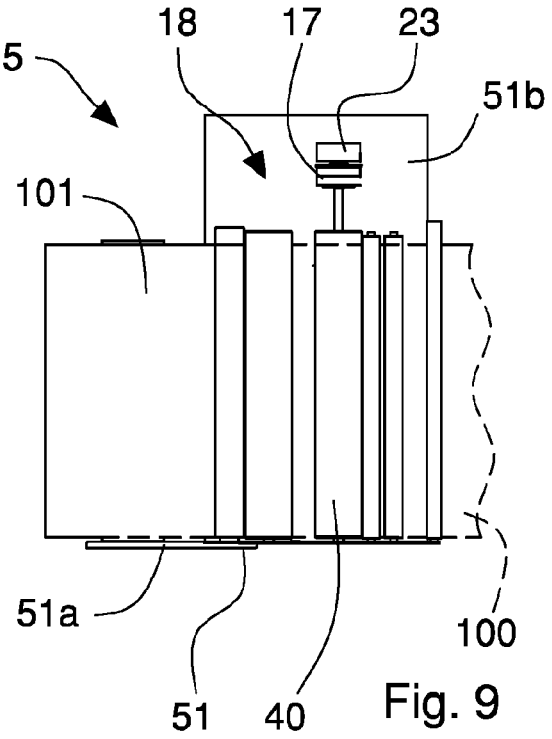
Fig. 9

Fig. 18
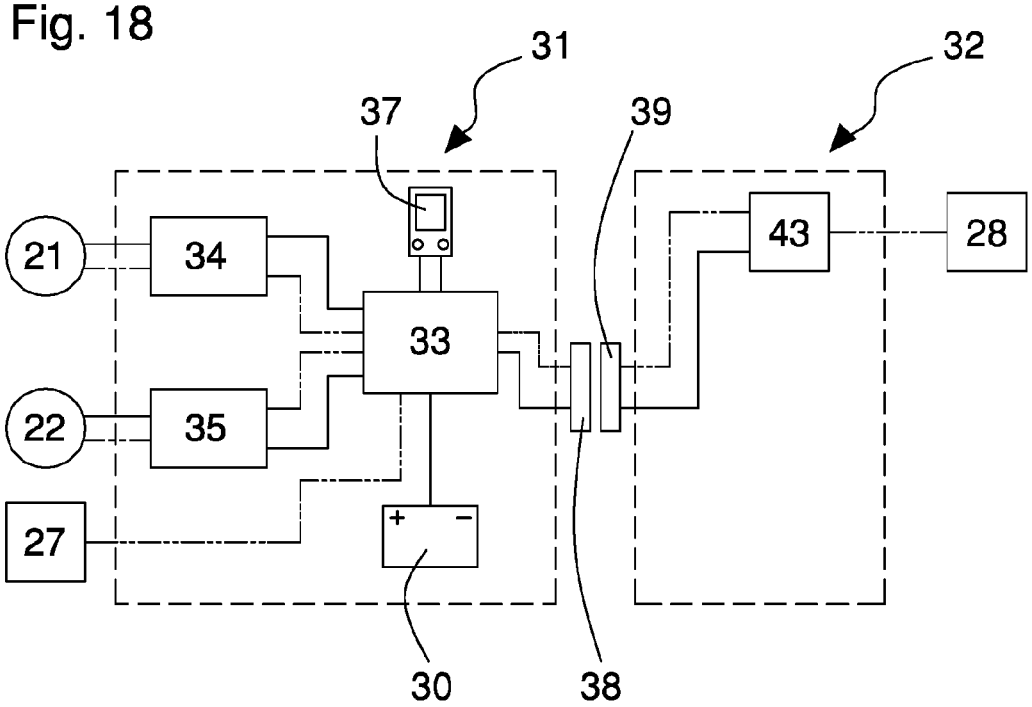
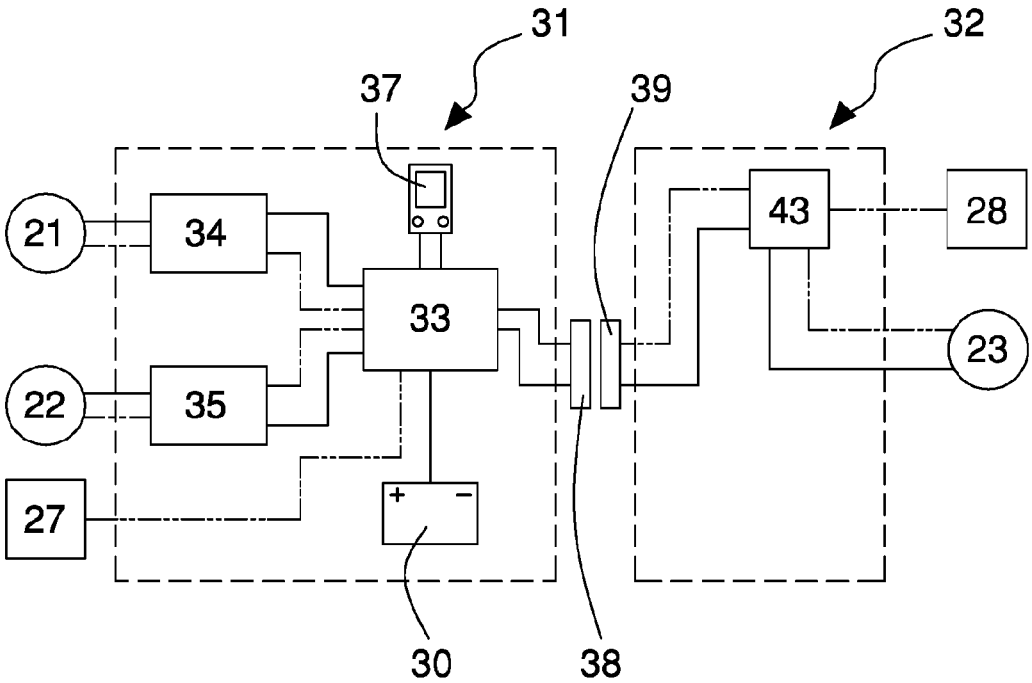
Fig. 19

SELF-PROPELLED WRAPPING MACHINE

The invention relates to mobile or self-propelled wrapping machines arranged to wrap a film of extensible plastic material around a load consisting of a product or a plurality of products arranged on a skid or pallet.

Self-propelled wrapping machines, also referred to as self-propelled wrapping robots, are machines generally used to wrap loads having variable shapes and sizes and in productions in limited amounts, typically in environments or rooms where fixed or static wrapping machines cannot be used because of the overall dimensions and/or available spaces. The loads are generally formed by skids or pallets on which a plurality of products and/or objects, also of different sizes and formats, are arranged, superimposed in a more or less regular manner.

In other cases, the wrapping, normally for protective purposes, directly concerns the product, which is generally large-sized.

Self-propelled wrapping machines include a cart or carriage that supports a vertical upright or post along which, with alternating rectilinear motion, is movable a film unwinding or dispensing unit which houses a plastic film reel and is provided with a plurality of rollers for unwinding the film and possibly pre-stretching or elongating it.

The carriage is generally provided with a motorized rear drive wheel and a front guide device which includes one or more steering wheels, operated by a steering. The steering can be operated via a guide bar by an operator to manually drive the machine in a maneuvering configuration, or by a feeler element capable of following the profile or external shape of the load in an operational working configuration, in which the self-propelled machine turns autonomously and automatically around the load to wrap it with the film.

The combination of the alternating linear movement of the unwinding unit along the vertical upright and the rotation of the self-propelled machine around the load allows the film to be wrapped around the latter so as to form a series of intertwined strips or bands. The plastic film is wrapped to completely bind up the load on all its sides.

Different types of unwinding units can be mounted on a self-propelled wrapping machine depending on the specific uses and user requests.

Unwinding units are known which, in addition to supporting the film reel, are provided with a plurality of rollers around which the film unwound from the reel winds before exiting the unwinding unit in the direction of the load to be wrapped.

One of the rollers (adjustment roller) is provided with an adjustable brake which allows to calibrate the winding tension of the film, i.e., the tension or force that the film exerts on the load during the wrapping. The brake acting on the adjustment roller can be a mechanical brake, manually adjustable, or an electromagnetic brake, controlled by a control unit of the self-propelled wrapping machine.

Unwinding units are also known which include a pair of pre-stretching rollers, i.e. a slow roller and a fast roller, respectively upstream and downstream with reference to the unwinding movement of the film, arranged to stretch and unwind the film, and one or more guiding rollers to divert the film towards the load during the unwinding.

By appropriately adjusting the difference between the rotational speeds of the two pre-stretching rollers, it is possible to stretch or elongate by a defined amount, according to a fixed pre-stretch or elongation percentage, the film exiting from the unwinding apparatus before it is wrapped on the load. By appropriately adjusting the speeds of the pre-stretching rollers, it is also possible to adjust the film wrapping tension around the load.

The aforesaid unwinding units are provided with an electric motor which drives in rotation one of the two pre-stretching rollers, which acts as a motor roller (typically the fast roller) and through a motion transmission assembly the other pre-stretching roller which acts as a driven roller (typically the slow roller). Thereby, a fixed transmission ratio is imposed between the fast roller and the slow roller, the value of which is a function of the value or percentage of pre-stretch or elongation to be obtained on the film. The mechanical driving assembly is substantially a speed reducer connecting the shaft of the fast roller to the shaft of the slow roller, reducing the angular rotation speed of the latter with respect to that of the fast roller.

Unwinding units are also known which comprise two electric motors that separately and independently drive the two pre-stretching rollers, allowing to vary the driving ratio quickly and easily, i.e., the pre-stretch percentage to be exerted on the film, also during operation.

The unwinding units described above can also be provided with a device for transversely narrowing, completely or partially, the film so as to reduce an amplitude or width of the strip or band so as to create a narrow band or a collected and compressed portion, substantially rolled or grouped of film which forms a kind of rope or cord, to be wrapped tightly around the load and the pallet. The narrow band obtained by progressively folding a longitudinal edge of the film transversely to the unwinding direction (so-called film creasing), allows, in fact, to obtain a higher wrapping force and a lower elastic elongation with respect to the film with full-width band.

The shrinking or folding device typically comprises a folding element, for example a roller, which is moved linearly and transversely to the film by an electric motor so as to intercept and abut a longitudinal edge of the film and push it towards an opposite longitudinal edge so as to reduce a width of the film band exiting the unwinding apparatus.

The different types of unwinding units that can be mounted on a self-propelled wrapping machine therefore have driving means that differ in number and type (electric motors, electromagnetic brakes).

As a result, depending on the unwinding unit to be installed on the self-propelled wrapping machine, the related electrical panel and the control unit must be appropriately configured. More precisely, the electrical panel must comprise all the drives capable of controlling the motors/brakes present on the unwinding unit and the control unit must be suitably programmed to control such drives.

During the construction of the self-propelled wrapping machine, at the time of assembly of the electrical panel, the type of wrapping unit which must be mounted on the self-propelled wrapping machine must therefore be already known and defined. In other words, the self-propelled wrapping machine with its electrical panel and the unwinding unit to be mounted thereon are already combined at an early step of the assembly.

In the event of an error or supervening need (changed as required by the market) that requires the assembly of a different type of unwinding unit, the electrical panel and the programming of the control unit must be modified and adapted, thus increasing production times and costs. Similarly, any subsequent replacement of the unwinding unit, for example at the request of a user, is impossible unless the entire self-propelled wrapping machine is reconditioned in the factory.

EP 2974642 discloses a self-propelled wrapping machine 10 movable around a load to be wrapped with a plastic film and comprising a self-propelled carriage 32 supporting an upright 16 along which a movement carriage is movable to which a reel holder unit 14 can be removably fixed so as to be easily replaced by other suitable reel holder units adapted to receive, for example, reels of film of different sizes or for maintenance operations.

WO 2020/012327 describes a self-propelled wrapping machine movable around a load to wrap the latter with a film and comprising a wrapping apparatus, which includes a support base, a column fixed thereto and an unwinding unit slidably supported by the column and adapted to feed the film unwound from a reel. The wrapping machine further comprises a movable automatic-driving vehicle arranged to be reversibly and automatically coupled to the support base in an assembled condition of the self-propelled wrapping machine to support and move the wrapping apparatus around the load and allow it to be wrapped with the film.

CN 202481348 U describes a self-propelled wrapping machine provided with an upright which slidably supports the unwinding unit and which is reversibly fixed to a self-propelled carriage provided with drive wheels on one of its rear ends driven by a battery.

An object of the invention is to improve the known self-propelled wrapping machines arranged to wrap a load with a film made of an extensible plastic material.

Another object is to create a self-propelled wrapping machine that allows a plurality of different types of film unwinding units to be mounted and used.

Another object is to create a self-propelled wrapping machine that allows an easy and quick replacement of the film unwinding unit with a different type of unwinding unit.

Another object is to create a flexible and economical self-propelled wrapping machine able to be easily configured according to user needs.

These objects and others are achieved by a machine according to one of the following claims. According to the invention a self-propelled wrapping machine is provided for wrapping a load with a plastic film comprising a self-propelled carriage, an upright fixed to the carriage and slidably supporting a moving slide movable along the upright and provided with connection means, first actuator means for respectively moving the carriage around the load and the moving slide along the upright, an unwinding unit provided with a reel of film and roller means at least for guiding and unwinding the film and comprising quick coupling means which can be coupled to, and uncoupled from, the connection means respectively to mount the unwinding unit on the moving slide in an assembled configuration and to disassemble the unwinding unit from the moving slide in a disassembled configuration. The unwinding unit is one of a plurality of unwinding units which can be reversibly coupled to the moving slide of said self-propelled wrapping machine.

The self-propelled wrapping machine according to the invention also comprises a main drive and control system associated with the carriage and/or the upright and configured to operate and control at least the first actuator means and a complementary drive and control system associated with the unwinding unit and configured to operate and control second actuator means and/or third actuator means acting on the roller means and/or to receive and process signals relating to operating parameters of the unwinding unit sent from sensor means of the latter. The first drive and control system and the complementary drive and control system are reversibly electrically connectable to each other by connector means to exchange control signals and transfer electric power supply.

By virtue of the invention it is possible to mount and fix unwinding units to the self-propelled wrapping machine in an easy and fast manner. It is also possible to quickly and easily replace an unwinding unit already installed on a self-propelled wrapping machine with another different unwinding unit. Thereby, the self-propelled wrapping machine of the invention is of the "modular" type, i.e., it consists of unwinding units that can be easily replaced and changed between each other, without changing the main drive and control system of the machine body of the self-propelled wrapping machine. The latter is thus particularly versatile and flexible in use.

The invention can be better understood and implemented with reference to the attached drawings which illustrate some exemplifying and non-limiting embodiments thereof, in which:

FIG. 3 is an enlarged detail of FIG. 2 illustrating a moving slide of the self-propelled wrapping machine provided with connection means and adapted to support a unwinding unit;

FIG. 4 is a schematic view of a first unwinding unit mountable on the self-propelled wrapping machine of the invention;

FIG. 5 is an enlarged detail of FIG. 4 illustrating first coupling means of the first unwinding unit;

FIG. 6 is a perspective view of a second unwinding unit mountable on the self-propelled wrapping machine of FIG. 1;

FIG. 7 is an enlarged detail of FIG. 6 illustrating second coupling means of the second unwinding unit;

FIG. 8 is a schematic front view of the first unwinding unit comprising first roller means;

FIG. 9 is a schematic front view of a variant of the first unwinding unit;

FIG. 18 is a simplified electrical diagram of the machine body of the self-propelled wrapping machine of FIG. 1 and of the first electrical panel of FIG. 14 mounted on the first unwinding unit of FIG. 8;

FIG. 19 is a simplified electrical diagram of the machine body of the self-propelled wrapping machine of FIG. 1 and of the first electrical panel of FIG. 14 mounted on the variant of the first unwinding unit of FIG. 9;

Figure 2:
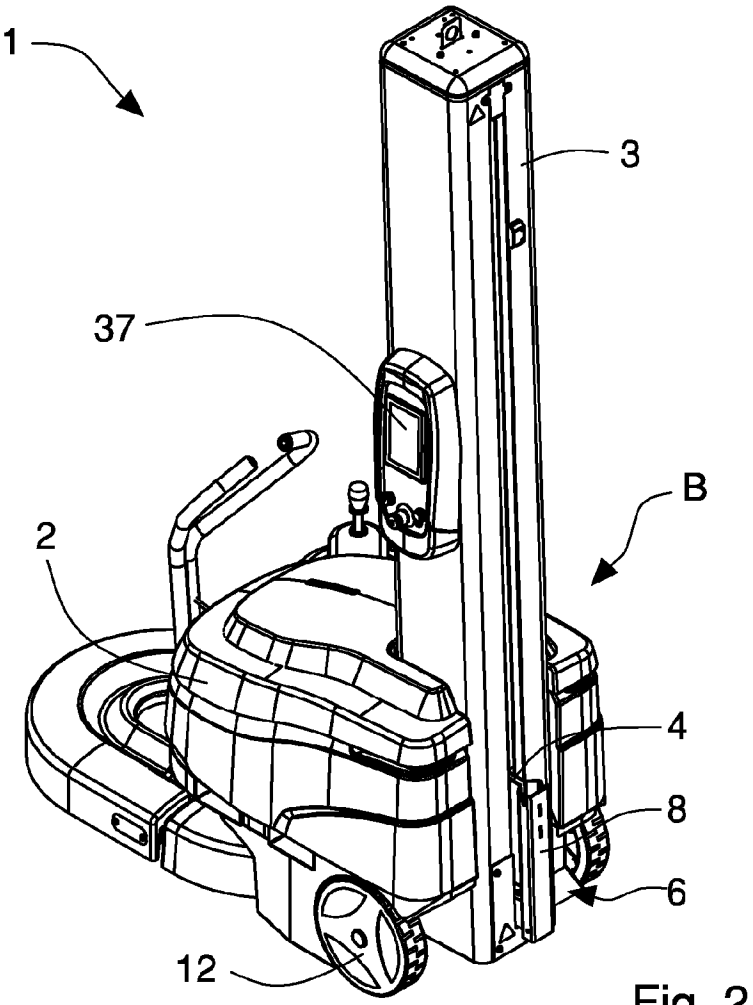
FIG. 2 is another rear perspective view of the self-propelled wrapping machine of the invention without the unwinding apparatus of the film.
Figure 1:
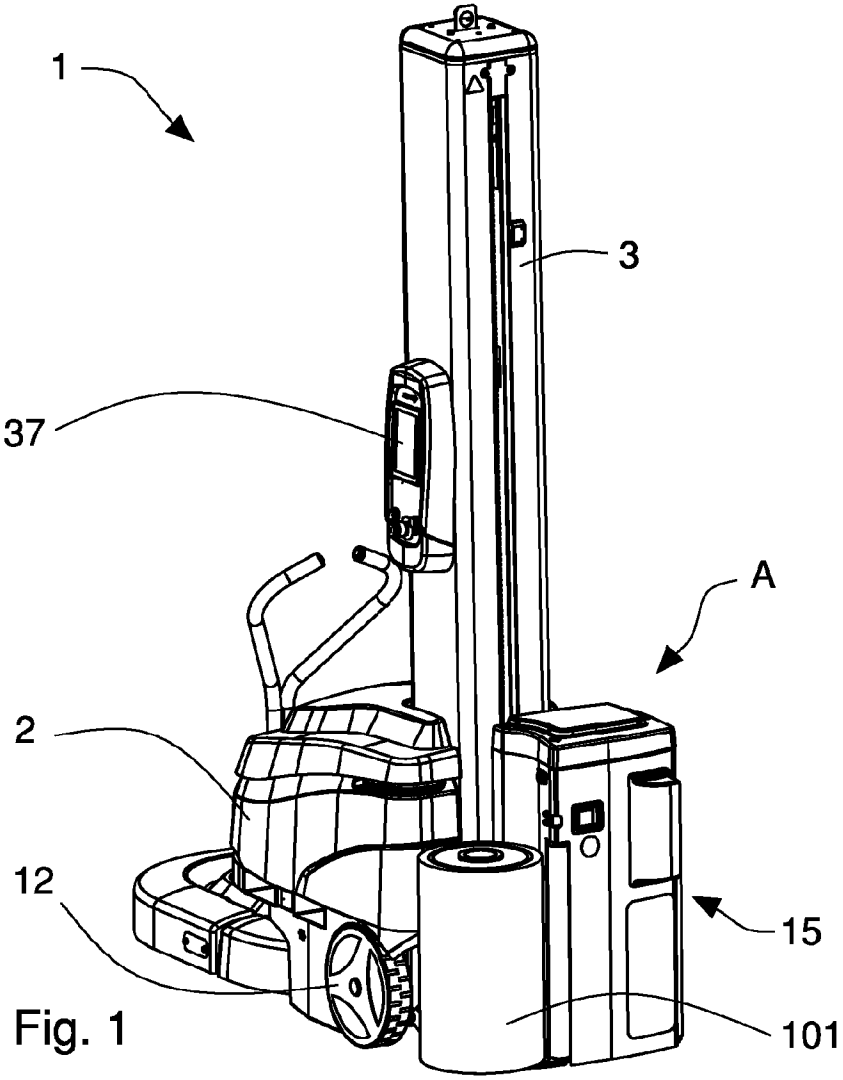
FIG. 1 is a rear perspective view of the self-propelled wrapping machine of the invention provided with an unwinding apparatus of the film.

With reference to FIGS. 1 to 2, a self-propelled wrapping machine 1 according to the invention is shown, movable around a load to wrap it with a plastic film 100, in particular of the cold-extensible type.

The self-propelled wrapping machine 1 comprises a self-propelled carriage 2, an upright 3, in particular substantially vertical, fixed to the carriage 2 and slidably supporting a moving slide 4 movable along the aforesaid upright 3 and provided with connection means 6 and first actuator means 21, 22 to move respectively the carriage 2 around the load and the moving slide 4 along the upright 3.

The first actuator means 21, 22 comprise a first electric motor 21 arranged to drive in rotation at least one drive wheel 12 of the self-propelled carriage 2 and a second electric motor 22 to move the moving slide 4 along the upright 3. The self-propelled wrapping machine 1 further comprises an unwinding unit provided with a reel 101 of film 100 and roller means 18, 19 configured at least for guiding and unwind the film from the reel.

The unwinding unit is one of a plurality of different unwinding units 5, 15 that can be mounted on the wrapping machine 1.

Each unwinding unit of said plurality of unwinding units 5, 15 comprises quick coupling means 7 which can be coupled to, and uncoupled from, the connection means 6 of the moving slide 4, respectively, for mounting the unwinding unit 5, 15 on the moving slide 4 in an assembled configuration A and to disassemble and extract the unwinding unit 5, 15 from the moving slide 4 in a disassembled configuration B.

Each unwinding unit 5, 15 comprises second actuator means 23 and/or third actuator means 24, 25, 26 acting on the roller means 18, 19.

Each unwinding unit 5, 15 comprises respective support means 51, 52 adapted to rotatably support the film reel 101, the roller means 18, 19 and the coupling means 7.

More precisely, the plurality of unwinding units 5; 15 which can be reversibly mounted on the self-propelled wrapping machine, i.e., which are reversibly coupled to the moving slide 4, comprise first unwinding units 5 and second unwinding units 25.

The first unwinding units 5 comprise first roller means 18 provided with a tightening roller 40 which can be braked by a first manually adjustable braking device 16 or by a second electromagnetic type braking device 17 that is operated by an electromagnetic actuator of the second actuator means 23.

The second unwinding units 15 comprise second roller means 19 provided with a first and a second pre-stretching roller 41, 42, configured to unwind and pre-stretch the film 100 and both rotated by a third electric motor 24 or separately and independently by a third and a fourth electric motor 24, 25 of the third actuator means 24, 25.

In a first unwinding unit 5, illustrated in FIGS. 4 and 8, the tightening roller 40 of the first roller means 18 can be braked, to adjust a tension or winding force exerted by the film when wrapped around the load, by a first braking device 16 manually adjustable by an operator.

In a variant of the first unwinding unit 15, illustrated in FIGS. 4 and 9, the tightening roller 40 of the first roller means 18 can be braked, to adjust a tension or winding force exerted by the film when wrapped around the load, by a second electromagnetic type braking device 17, i.e. driven by an electromagnetic actuator 23.

Figure 10:
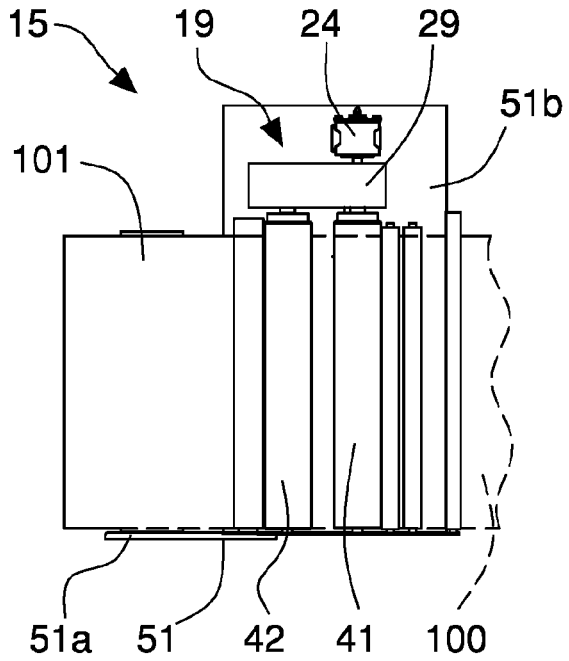
FIG. 10 is a schematic front view of a second unwinding unit comprising second roller means.

A second unwinding unit 15, illustrated in FIGS. 6 and 10, comprises a third electric motor 24 that rotates the first pre-stretching roller 41 (fast roller) and, by means of a speed reducing device 29, the second pre-stretching roller 42 (slow roller).

Figure 11:
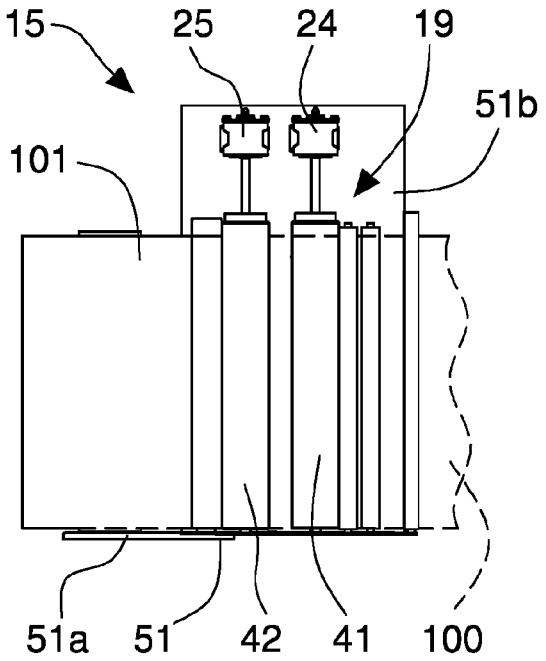
FIG. 11 is a schematic front view of a first variant of the second unwinding unit.

A first variant of the second unwinding unit 15, schematically illustrated in FIGS. 6 and 11, comprises a third and a fourth electric motor 24, 26 for separately and independently rotating the first and the second pre-stretching roller 41, 42.

The second unwinding units 15 described above can also comprise a narrowing device 55 of the film 100 configured to abut a longitudinal edge of the film and push it towards the opposite longitudinal edge so as to reduce a band width of the film. The narrowing device 55 is driven by a fifth electric motor 26.

Figure 12:
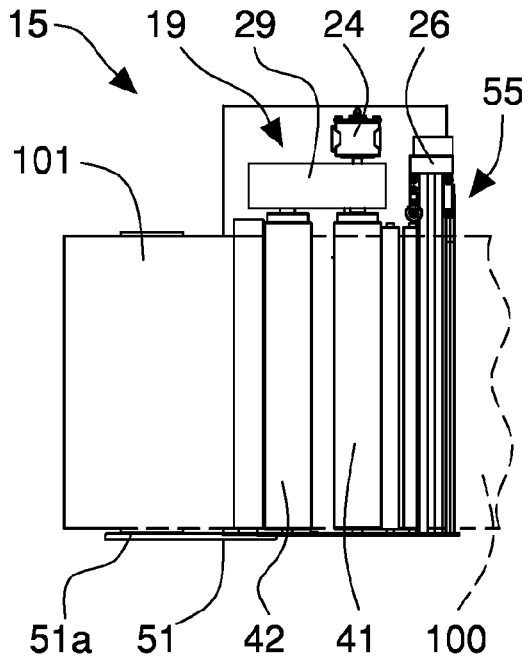
FIG. 12 is a schematic front view of a second variant of the second unwinding unit.

A second variant of the second unwinding unit 15, schematically illustrated in FIGS. 6 and 12, is provided with the third electric motor 24, which rotates the first pre-stretching roller 41 (fast roller) and, by means of the speed reducing device 29, the second pre-stretching roller 42 (slow roller) and the narrowing device 55 driven by the fifth electric motor 26.

Figure 13:
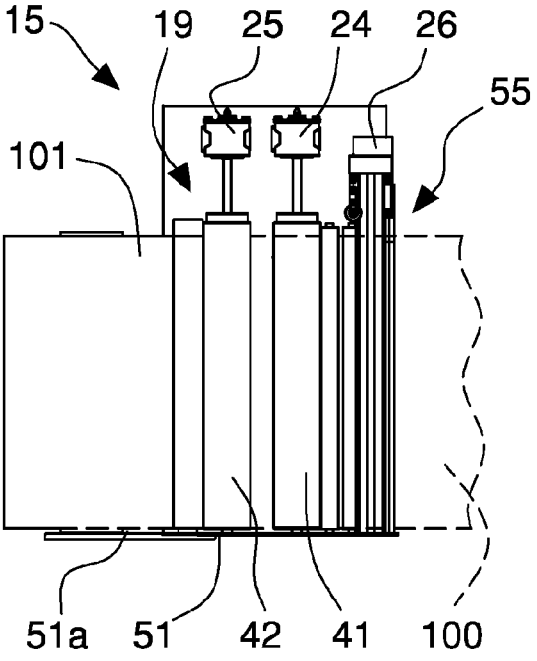
FIG. 13 is a schematic front view of a third variant of the second unwinding unit.

In FIG. 13 a third variant of the second unwinding unit 15 is schematically illustrated which is provided with a third and a fourth electric motor 24, 25 for separately and independently rotating the first and the second pre-stretching roller 41, 42 and a fifth electric motor 26 for driving the film narrowing device 55.

In FIG. 1 the self-propelled wrapping machine 1 supporting a second unwinding unit 15 is shown.

With reference to FIGS. 2 and 3, the connection means 6 of the moving slide 4 include an elongated connection element 8, in particular longitudinally and parallel to the upright 3, fixed to the moving slide 4 and externally protruding from the upright 3. The connection element 8 comprises a respective upper end **8*a* provided with an open transverse seat 9**.

In the illustrated embodiment, the connection element 8 is formed by a closed section profile and the transverse seat 9 is formed by two recesses made on opposite peripheral edges of the upper end **8*a***.

With particular reference to FIGS. 6 and 7, which illustrate a second unwinding unit 15, the coupling means 7 comprise an elongated cavity 11, in particular longitudinally, made in second supporting means 52 of the second unwinding unit 15 and having a shape complementary to that of the connection element 8.

The second supporting means 52 comprise a support frame **52*a* that rotatably supports the film reel 101 and the roller means 19 and a containment casing 52*b* that houses the second roller means 19 and comprises the connection means 7. More precisely, the cavity 11 is made on a rear wall of the containment casing 52*b* of the supporting means 52 of said second unwinding unit 15**.

The cavity 11 has a respective upper end **11*a* to which a transverse supporting pin 13 is fixed. In the assembled configuration A of the second unwinding unit 15 the transverse seat 9 of the connection element 8 receives and supports the transverse supporting pin 13 and the connection element 8 is inserted and contained within the cavity 11**.

The coupling means 7 also include a further transverse locking pin 14 insertable in a respective lower end **11*b* of the cavity 11 and in a respective lower end 8*b* of the connection element 8. More precisely, the further transverse locking pin 14 is insertable in the assembled configuration A in a pair of first parallel and opposite through holes 48 made on the lower end 8***b* of the connection element 8 and in a pair of second parallel and opposite through holes 49 made on the lower end 11*b* of the cavity 11.

With particular reference to FIGS. 4 and 5 illustrating a first unwinding unit 5, the cavity 11 of the coupling means 7 having a complementary shape to that of the connection element 8 is made on the first supporting means 51 of the unwinding unit 15.

The first supporting means 51 comprise a first supporting frame 51*a* that rotatably supports the film reel 101 and the first roller means 18 and a first containment casing 51*b* that houses the first roller means 19 and comprises the connection means 7. More precisely, the cavity 11 is formed in an open transverse section profile 53 of the first containment casing 51*b*. The cavity 11 has a respective upper end 11*a* to which a transverse supporting pin 13 is fixed and a respective lower end 11*b* on which the second through holes 49 are made, adapted to receive the further transverse locking pin 14 in the assembled configuration A of the first unwinding unit 5 on the self-propelled wrapping machine 1.

Referring to FIGS. 18 to 22, the self-propelled wrapping machine 1 of the invention comprising a main drive and control system 31 and a complementary drive and control system 32. The main drive and control system 31 is associated with a machine body consisting of the carriage 2 and the upright 3 and is configured to operate and control the first actuator means 21, 22 which move the carriage 2 around the load and the moving slide 4 along the upright 3.

The complementary drive and control system 32 is associated with the unwinding unit 5, 15 and is configured to drive and control the second and third actuator means 23, 24, 25, 26 acting on the roller means 18, 19 and/or to receive and process signals relating to operating parameters of the unwinding unit detected by sensor means 28 of the latter.

The main drive and control system 31 and the complementary drive and control system 32 are electrically reversibly connectable by connector means 38, 39 so as to exchange control signals and transfer electrical power (the electrical power supply is from the main drive and control system 31 to the complementary drive and control system 32).

The connector means 38, 39 comprise a first connector 38 and a second connector 39 which can be reversibly coupled to each other in the assembled configuration A. The first connector 38 is associated with the main drive and control system 31 and positioned on the moving slide 4 at the connection means 6 and the second connector 39 is associated with the complementary drive and control system 32 and positioned on the unwinding unit 5, 15 at said coupling means 7.

The main drive and control system 31 comprises a first control unit 33, for example a PLC or industrial computer, first drive means 34, 35 for powering and controlling the first actuator means 21, 22 and connected and controlled by the first control unit 33, a control panel 37 connected to the first control unit 33 and at least one electric battery 30 for powering the entire self-propelled wrapping machine 1, i.e., the machine body and the unwinding unit 5, 15.

The first control unit 33 and the first drive means 34, 35 are contained within a main electrical panel of the machine body, of a known type and not illustrated in the figures.

The main drive and control system 31, in particular the first control unit 33, is also configured to receive and process signals relating to operating parameters of the machine body 10 detected by respective sensor means 27.

The first actuator means 21, 22 comprise the first electric motor 21 and the second electric motor 22 and the first drive means 34, 35 comprising a first and a second drive unit 34, 35 adapted to power and control, respectively, the first and the second electric motor 21, 22.

The complementary drive and control system 32 comprises a second control unit 43, for example a PLC, adapted to receive and process signals from the sensor means 28 and based on the type of first unwinding unit to which it is associated, also powering and controlling the second actuator means 23, comprising the electromagnetic actuator of the electromagnetic braking device 17, or controlling second drive means 44, 45, 46 adapted to power and control the third actuator means 24, 25, 26 including the third, fourth and fifth electric motor 24, 25, 26.

Each unwinding unit of the plurality of unwinding units 5, 15 comprises a respective electrical panel that includes the complementary drive and control system 32. The electrical panel is fixed to the supporting means 51, 52 of the unwinding unit 5, 15, in particular to the containment casing 51*b*, 52*b*.

Figure 14:
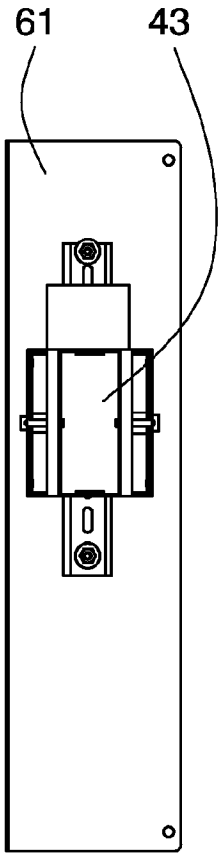
FIG. 14 is a front view of a first electrical panel installable on the first unwinding units.
Figure 20:
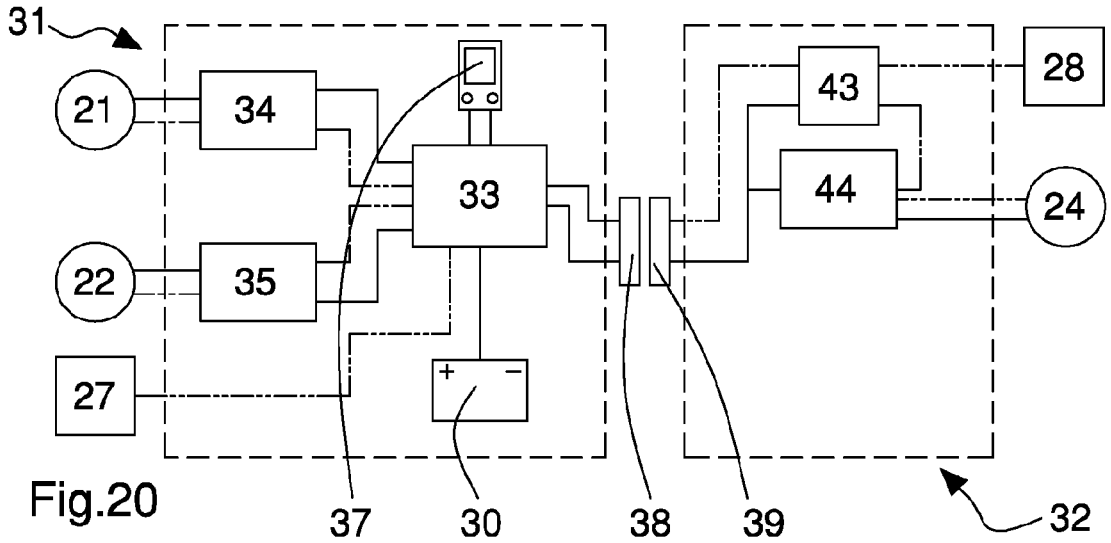
FIG. 20 is a simplified electrical diagram of the machine body of the self-propelled wrapping machine of FIG. 1 and of the second electrical panel of FIG. 15.
Figure 21:
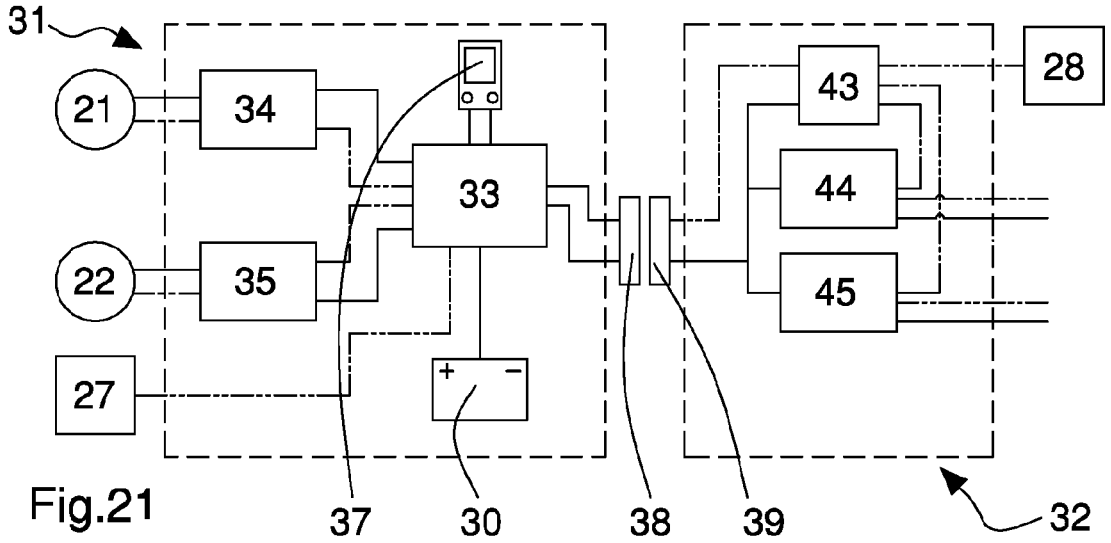
FIG. 21 is a simplified electrical diagram of the machine body of the self-propelled wrapping machine of FIG. 1 and of the third electrical panel of FIG. 16
Figure 22:
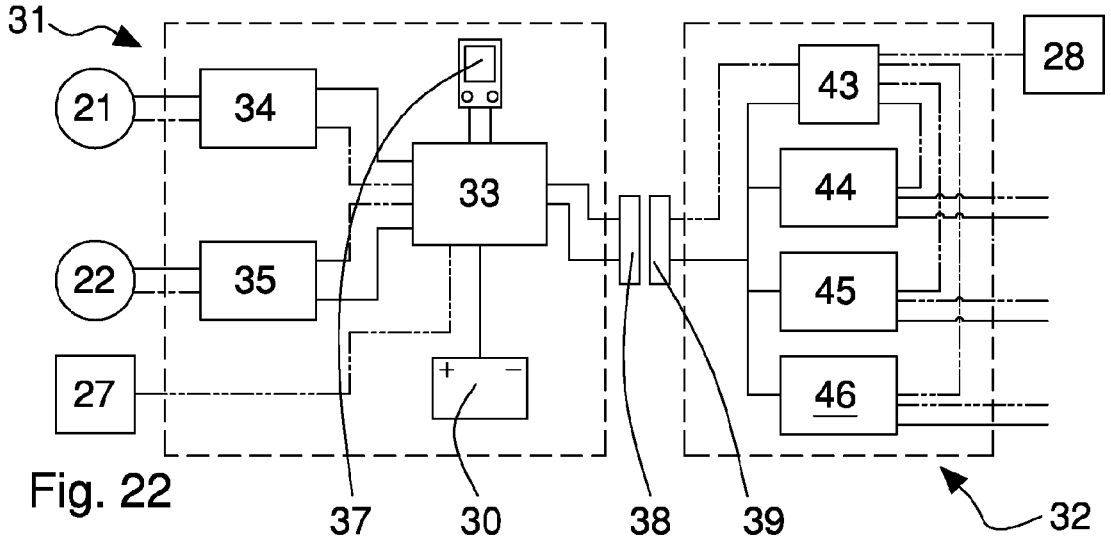
FIG. 22 is a simplified electrical diagram of the machine body of the self-propelled wrapping machine of FIG. 1 and of the fourth electrical panel of FIG. 17.

The first unwinding unit 5 provided with the tightening roller 40 connected to the manually drivable and adjustable braking device 16 is provided with a first electrical panel 61 (FIG. 14) which includes a respective complementary drive and control system 32 (FIG. 18) which comprises a second control unit 43 configured to receive and process the signals detected and transmitted by the sensor means 28. The second control unit 43 in turn sends information relating to the received and processed signals to the first control unit 33 of the main drive and control system 31.

The variant of the first unwinding unit 5 provided with the electromagnetic braking device 17 drivable and adjustable to brake the tightening roller 40, is provided with the same first electrical panel 61 and the same complementary drive and control system 32 in which the second control unit 43 also powers and controls the electromagnetic actuator 23 of the electromagnetic braking device 17 (FIG. 10).

Figure 15:
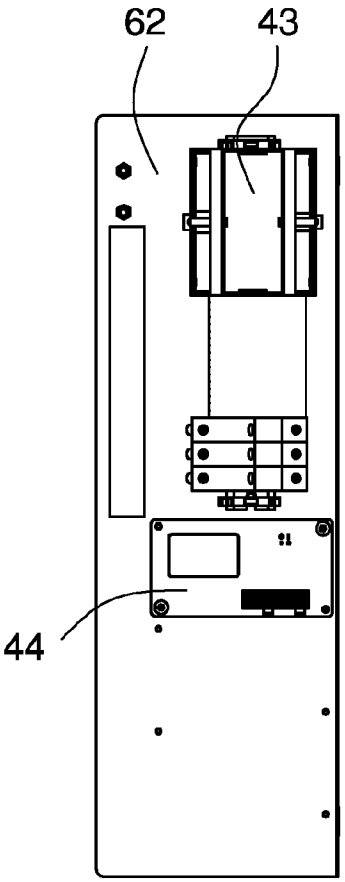

The second unwinding unit 15 comprising the third electric motor 24, which rotates the first pre-stretching roller 41 and the second pre-stretching roller 42, is provided with the second electrical panel 62 (FIG. 15) which includes a respective complementary drive and control system 32 (FIG. 20) which comprises in addition to the second control unit 43 the second drive means 44 configured to power and control the third actuator means 24. In this embodiment, the second drive means 44 comprise a third drive unit 44 adapted to power and control the third electric motor 24. The second control unit 43 is configured to receive and process the signals sent by the sensor means 28 and to control the second drive means 44.

Figure 16:
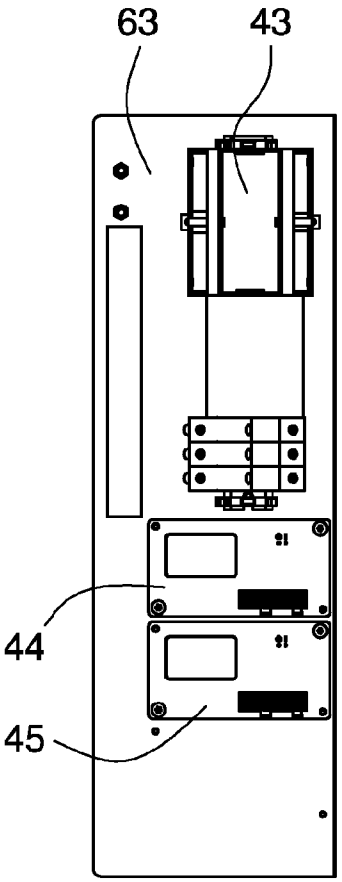

The first variant of the second unwinding unit 15 comprising a third and a fourth electric motor 24, 25 for separately and independently rotating the first and the second pre-stretching roller 41, 42 is provided with the third electrical panel 63 (FIG. 16) which includes a respective complementary drive and control system 32 (FIG. 21) which comprises the second control unit 43 and the second drive means 44, 45 configured to power and control the third actuator means 24, 25, i.e., the third and the fourth electric motor 14, 15. In this embodiment, the second drive means 44, 45 comprise a third drive unit 44 and a fourth drive unit 45 adapted to power and control the third electric motor 24 and the fourth electric motor 25.

Each of the two drive units 44, 45 can power and control any of the two electric motors 24, 26.

The second control unit 43 is configured to receive and process the signals sent by the sensor means 28 and to control the second drive means 44, 45.

The second variant of the second unwinding unit 15 comprising the third electric motor 24, which rotates both the pre-stretching rollers 41, 42 and the fifth electric motor 26 of the narrowing device 55 is provided with the same third electrical panel 63 and the same complementary drive and control system 32 in which the third drive unit 44 and the fourth drive unit 45 of the second drive means 44, 45 are configured to power and control the third electric motor 24 and the fifth electric motor 25.

Each of the two drive units 44, 45 can power and control any of the two electric motors 24, 26.

The second control unit 43 is configured to receive and process the signals sent by the sensor means 28 and to control the second drive means 44, 45.

Figure 17:
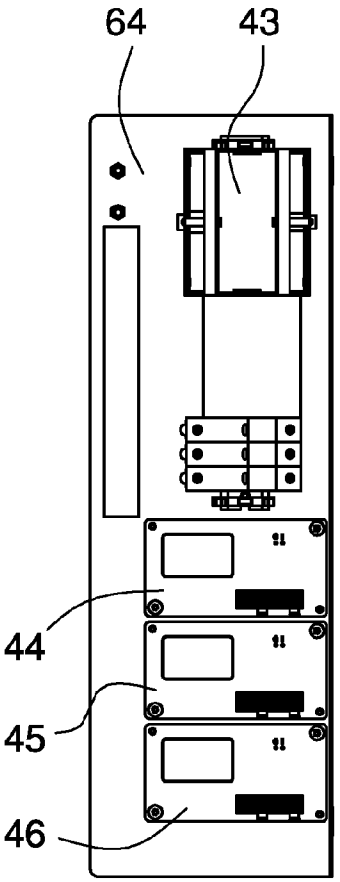
FIGS. 15 to 17 are front views respectively of a second, a third and a fourth electrical panel installable on the second unwinding unit and on its variants.

The third variant of the second unwinding unit 15 comprising the third and the fourth electric motor 24, 25 for separately and independently rotating the first and the second pre-stretching roller 41, 42 and the fifth electric motor 26 for driving the film narrowing device 55, is provided with the fourth electrical panel 64 (FIG. 17) which includes a respective complementary drive and control system 32 (FIG. 22) which comprises the second control unit 43 and the second drive means 44, 45, 46 configured to power and control the third actuator means 24, 25, 26, i.e., the third, fourth and fifth electric motors 24, 25, 26. In this embodiment, the second drive means 44, 45, 46 comprise a third drive unit 44, a fourth drive unit 45 and a fifth drive unit 46 adapted to power and control the third electric motor 24, the fourth electric motor 25 and the fifth electric motor 26.

Each of the three drive units 44, 45, 46 can power and control any of the three electric motors 24, 25, 26.

The second control unit 43 is configured to receive and process the signals sent by the sensor means 28 and to control the second drive means 44, 45, 46.

In an assembly step of the self-propelled wrapping machine 1 of the invention it is thus possible to quickly and easily mount on the moving slide 4 one of the different unwinding units 5, 15, which is selected, for example, according to the requests and needs of the user.

By virtue of the connection means 6 of the moving slide 4 and the coupling means 7 of the unwinding unit 5, 15, the latter can be mounted and fixed to the self-propelled wrapping machine easily and quickly. Furthermore, since the unwinding unit 5, 15 is provided with its own electrical panel 61, 62, 63, 64 comprising the complementary drive and control system 32 (configured to drive and control the second or third actuator means 23, 24, 25, 26 acting on the roller means 18, 19 and/or to receive and process signals relating to operating parameters of the unwinding unit 5, 15 detected by the sensor means 28) it is not necessary to modify and/or integrate the main drive and control system 31 of the machine body, for example by adding drive units and/or electrical connections with the second and third actuator means 23, 24, 25, 26.

In fact, it is sufficient to electrically connect the two drive and control systems 31, 32, by the connector means 38, 39 and select from the control panel 37 the type of unwinding unit 5, 15 mounted to use the corresponding operating programs. Alternatively, specific operating programs for the mounted unwinding unit can be quickly installed on the first control unit 33 of the self-propelled wrapping machine.

The second control unit 43 of the complementary drive and control system 32 is in fact able to command and control the operation of the unwinding unit on the basis of the instructions received from the first control unit 33 for the coordinated operation of the first, second or third actuator means 21, 22, 23, 24, 25, 26 as a function of the set wrapping cycle and the signals sent by the sensor means 27, 28 of the machine body and the unwinding unit.

It should also be noted that the third electrical panel 63 with the respective complementary drive and control system 32 can be installed on a second unwinding unit 15 including a third and a fourth electric motor 24, 25 to separately and independently rotate the first and the second pre-stretching roller 41, 42 or on a second unwinding unit 15 including the third electric motor 24 to rotate both the pre-stretching rollers 41, 42 and the fifth electric motor 26 of the narrowing device 55.

The self-propelled wrapping machine of the invention also makes it possible to quickly and easily replace an unwinding unit already installed on a self-propelled wrapping machine, for example in use at a user's premises, with another different unwinding unit 5, 15, for example to respond to changing production needs. Thereby, the self-propelled wrapping machine 1 is of the "modular" type, i.e., it consists of unwinding units 5, 15 which can be easily replaced and changed between each other, without changing the main drive and control system 31 of the machine body of the self-propelled wrapping machine 1. The latter is thus particularly versatile and flexible in use.

The invention claimed is:

1. A self-propelled wrapping machine movable around a load for wrapping the load with a plastic film, the self-propelled wrapping machine comprising:

a self-propelled carriage to move the self-propelled wrapping machine around the load;

an upright fixed to said self-propelled carriage and slidably supporting a moving slide movable along said upright, said moving slide being provided with a connection assembly;

a first actuator arrangement to move respectively said self-propelled carriage around the load and said moving slide along said upright;

an unwinding unit to be provided with a reel of film, said unwinding unit having a roller assembly at least for guiding and unwinding the said film and a quick coupling assembly configured to be coupled to and uncoupled from said connection assembly respectively to mount said unwinding unit on said moving slide in an assembled configuration and to disassemble said unwinding unit from said moving slide in a disassembled configuration;

a main drive and control system associated with at least one of said self-propelled carriage or said upright and configured to operate and control at least said first actuator arrangement; and a complementary drive and control system associated with said unwinding unit and configured to operate and/or control at least one of a second actuator arrangement or a third actuator arrangement acting on said roller assembly and to receive and process signals relating to operating parameters of said unwinding unit from a sensor device thereof, wherein said main drive and control system and said complementary drive and control system are reversibly electrically connectable to each other by connectors to exchange control signals and transfer electric power supply.

2. The self-propelled wrapping machine according to claim 1, wherein said unwinding unit is one of a plurality of unwinding units configured to be reversibly coupled to said moving slide of the self-propelled wrapping machine.

3. The self-propelled wrapping machine according to claim 2, wherein each unwinding unit of said plurality of unwinding units comprises a respective electrical panel comprising said complementary drive and control system.

4. The self-propelled wrapping machine according to claim 1, wherein said main drive and control system comprises at least a first control unit, a first drive assembly for powering and controlling said first actuator arrangement, said first drive assembly being connected to and controlled by said first control unit, a control panel connected to said first control unit, and at least one electric battery to power the self-propelled wrapping machine.

5. The self-propelled wrapping machine according to claim 4, wherein said first actuator arrangement comprises a first electric motor to rotate at least one drive wheel of said self-propelled carriage and a second electric motor for moving said moving slide along said upright, said first drive assembly comprising a first drive unit and a second drive unit to power and control respectively said first electric motor and said second electric motor.

6. The self-propelled wrapping machine according to claim 1, wherein said connectors comprise a first connector and a second connector configured to be reversibly coupled to each other in the assembled configuration, said first connector being associated with said main drive and control system and positioned on said moving slide at said connection assembly and said second connector being associated with said complementary drive and control system and positioned on said unwinding unit at said quick coupling assembly.

7. The self-propelled wrapping machine according to claim 1, wherein said complementary drive and control system comprises a second control unit at least to receive and process signals from said sensor device.

8. The self-propelled wrapping machine according to claim 1, wherein said complementary drive and control system comprises a second control unit for receiving and processing signals from said sensor device and for supplying and controlling said second actuator arrangement.

9. The self-propelled wrapping machine according to claim 1, wherein said complementary drive and control system comprises a second control unit and a second drive assembly to power and control said third actuator arrangement, said second control unit being configured to receive and process signals sent by said sensor device and to control said second drive assembly.

10. The self-propelled wrapping machine according to claim 1, wherein said unwinding unit is one of a plurality of unwinding units that are configured to be reversibly coupled to said moving slide of the self-propelled wrapping machine, said plurality of unwinding units comprising:

a plurality of first unwinding units provided with a first roller assembly comprising a tightening roller that is configured to be braked by a manual braking device that is configured to be operated and adjusted manually or an electromagnetic braking device that is configured to be operated and adjusted by said second actuator arrangement; and a plurality of second unwinding units provided with a second roller assembly comprising a first pre-stretching roller and a second pre-stretching roller to unwind and pre-stretch the film, and wherein said third actuator arrangement comprises a third electric motor to rotate both said first and second pre-stretching rollers or a third electric motor and a fourth electric motor to rotate separately and independently said first pre-stretching roller and said second pre-stretch roller.

11. The self-propelled wrapping machine according to claim 10, wherein each of said second unwinding units of said plurality of unwinding units further comprises a narrowing device of the film configured to abut a longitudinal edge of the film and push the film towards an opposite longitudinal edge so as to reduce a band width of the film, said narrowing device being driven by a fifth electric motor of said third actuator arrangement.

12. The self-propelled wrapping machine according to claim 9, wherein said second drive assembly comprises at least one drive unit for powering and controlling a respective electric motor.

13. The self-propelled wrapping machine according to claim 1, wherein said connection assembly includes an elongated connection element fixed to said moving slide and externally protruding from said upright, said elongated connection element comprising a respective upper end provided with an open transverse seat, wherein said quick coupling assembly includes an elongated cavity made in a supporting assembly of said unwinding unit, said elongated cavity having a shape complementary to that of said elongated connection element and provided with a respective upper end to which a transverse supporting pin is fixed, and wherein, in the assembled configuration of said unwinding unit, said open transverse seat of said elongated connection element receives and supports said transverse supporting pin and said elongated connection element is inserted and contained within said elongated cavity.

14. The self-propelled wrapping machine according to claim 13, wherein said quick coupling assembly includes a further transverse locking pin that is configured to be inserted in a respective lower end of said elongated cavity and in a respective lower end of said elongated connection element.

* * * * *